US012766591B2

(12) United States Patent
Aramaki et al.

(10) Patent No.: US 12,766,591 B2
(45) **Date of Patent: *Oct. 20, 2026**

(54) STEEL CONTINUOUS CASTING METHOD

(71) Applicant: JFE STEEL CORPORATION, Tokyo (JP)

(72) Inventors: Norichika Aramaki, Tokyo (JP); Shuhei Irie, Tokyo (JP); Akitoshi Matsui, Tokyo (JP); Hirokazu Sugihara, Tokyo (JP); Yusuke Nojima, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 67 days.

This patent is subject to a terminal disclaimer.

(21) Appl. No.: 18/730,104

(22) PCT Filed: Mar. 23, 2023

(86) PCT No.: PCT/JP2023/011463

§ 371 (c)(1),
(2) Date: Jul. 18, 2024

(87) PCT Pub. No.: WO2023/190018

PCT Pub. Date: Oct. 5, 2023

(65) Prior Publication Data

US 2025/0144702 A1 May 8, 2025

(30) Foreign Application Priority Data

Mar. 28, 2022 (JP) ..... 2022-051592

(51) Int. Cl.
*B22D 11/124* (2006.01)
*B22D 11/22* (2006.01)

(52) U.S. Cl.
CPC ..... *B22D 11/1246* (2013.01); *B22D 11/22* (2013.01)

(58) Field of Classification Search
CPC . B22D 11/122; B22D 11/1246; B22D 11/124; B22D 11/14; B22D 11/142
See application file for complete search history.

(56) References Cited

U.S. PATENT DOCUMENTS

2022/0152694 A1* 5/2022 Irie ..... B22D 11/16

FOREIGN PATENT DOCUMENTS

CN 101678447 A 3/2010
EP 2 165 788 A1 3/2010
(Continued)

OTHER PUBLICATIONS

Han, Z. et al., " Development and Application of Dynamic Soft-reduction Control Model to Slab Continuous Casting Process," ISIJ International, vol. 50, No. 11, 2010, pp. 1637-1643.
(Continued)

*Primary Examiner* — Keith Walker
*Assistant Examiner* — Steven S Ha
(74) *Attorney, Agent, or Firm* — Oliff PLC

(57) ABSTRACT

A steel continuous casting method effectively reducing center segregation occurring inside a cast piece includes cooling of a cast piece performed with a water volume density per surface area of the cast piece in a first section set within a range of 50 to 2000 L/($m^2$×min) or lower. The first section is a range along a cast piece withdrawing direction in a continuous casting machine, from a start point at which an average value of a solid phase ratio along a thickness direction at a final solidified part in a cast piece width direction is 0.8 or lower to an end point at which the average value of the solid phase ratio along the thickness direction at the final solidified part in the cast piece width direction is higher than the solid phase ratio at the start point but not higher than 1.0.

17 Claims, 4 Drawing Sheets

(56) References Cited

FOREIGN PATENT DOCUMENTS

| | | | | |
|---|---|---|---|---|
| EP | 2881196 | A1 * | 6/2015 | ..... B22D 11/208 |
| EP | 3 488 947 | A1 | 5/2019 | |
| EP | 3 932 586 | A1 | 1/2022 | |
| JP | H07-001096 | A | 1/1995 | |
| JP | H08-132203 | A | 5/1996 | |
| JP | H08-192256 | A | 7/1996 | |
| JP | H08-224650 | A | 9/1996 | |
| JP | 2001-062550 | A | 3/2001 | |
| JP | 2008-100249 | A | 5/2008 | |
| JP | 2009-297756 | A | 12/2009 | |
| JP | 2012-110898 | A | 6/2012 | |
| JP | 2013-244492 | A | 12/2013 | |
| JP | 2016-028827 | A | 3/2016 | |
| JP | 2019-155419 | A | 9/2019 | |
| RU | 2 185 927 | C2 | 7/2002 | |
| RU | 2 422 242 | C2 | 6/2011 | |
| RU | 2 564 192 | C1 | 9/2015 | |
| SU | 508331 | A1 | 3/1976 | |
| TW | 201813740 | A | 4/2018 | |
| WO | WO-2020203715 | A1 * | 10/2020 | ..... B22D 11/142 |

OTHER PUBLICATIONS

Mar. 11, 2025 extended Search Report issued in European Patent Application No. 23780029.7.

May 16, 2023 International Search Report issued in International Patent Application No. PCT/JP2023/011463.

Jul. 18, 2023 Office Action issued in Japanese Patent Application No. 2023-538740.

Jun. 16, 2020 International Search Report issued in International Patent Application No. PCT/JP2020/013885.

Nov. 24, 2020 Office Action issued in Taiwanese Patent Application No. 109110943.

Aug. 20, 2021 Office Action issued in Taiwanese Patent Application No. 109110943.

Sep. 7, 2021 Office Action issued in Japanese Patent Application No. 2020-556823.

Apr. 29, 2022 Office Action issued in Russian Patent Application No. 2021128610.

Mar. 31, 2022 Search Report issued in European Patent Application No. 207825803.

Aug. 24, 2022 Office Action issued in Chinese Patent Application No. 202080026097.7.

Jan. 9, 2023 Office Action Issued in U.S. Appl. No. 17/600,899.

Jan. 30, 2023 Office Action issued in Korean Patent Application No. 10-2021-7031360.

May 8, 2023 Notice of Allowance Issued in U.S. Appl. No. 17/600,899.

Aug. 1, 2023 Office Action issued in Korean Patent Application No. 10-2021-7031360.

* cited by examiner

STEEL CONTINUOUS CASTING METHOD

TECHNICAL FIELD

The present invention relates to a steel continuous casting method, and particularly proposes a steel continuous casting method that is effective in reducing center segregation occurring inside a cast piece.

BACKGROUND ART

It is generally known that in a steel solidification process, solute elements, such as carbon, phosphorous, sulfur, and manganese, are concentrated toward an unsolidified liquid phase side due to redistribution during solidification, resulting in the formation of micro segregation between dendrites.

When casting steel using a continuous casting machine, a continuous casting piece (hereinafter also referred to simply as a "cast piece") that is solidifying sometimes forms a void or develops a negative pressure at a center part in the thickness of the cast piece due to solidification contraction or thermal contraction or to bulging of a solidification shell that occurs between rolls of the continuous casting machine. As a result, molten steel is suctioned to the center part in the thickness of the cast piece. However, as there is not a sufficient amount of molten steel present in an unsolidified layer at a last solidification stage, molten steel between dendrites in which the aforementioned solute elements have concentrated is suctioned and moves to the center part in the thickness and solidifies there. A segregation spot thus formed at the center part in the thickness of the cast piece has a far higher value of the concentration of the solute elements compared with the initial concentration in the molten steel. This phenomenon is generally called "macro segregation," and is also called "center segregation" because of the region where it is present.

The above-described center segregation of cast piece significantly degrades the quality of steel materials, for example, the quality of line pipe materials for transportation of crude oil, natural gas, etc. Such quality degradation of steel materials is caused, for example, as hydrogen having entered inside steel by a corrosion reaction diffuses and aggregates around manganese sulfide (MnS) or niobium carbide (NbC) having formed at a center segregation part, etc. and causes cracking due to the internal pressure. Since such a center segregation part has hardened due to highly concentrated solute elements, this cracking further propagates and expands to the surrounding area. This cracking is what is called hydrogen-induced cracking (HIC). Thus, reducing the center segregation at the center part in the thickness of the cast piece is extremely important in improving the quality of steel products.

Many technologies for reducing the center segregation of cast piece from a continuous casting step to a rolling step or making it harmless have been hitherto proposed. For example, Patent Literature 1 and Patent Literature 2 propose a technology in which, in a continuous casting machine, a cast piece at a last solidification stage that has an unsolidified layer is cast while being gradually reduced by cast piece support rolls by an amount of reduction approximately corresponding to a sum of a solidification contraction amount and a thermal contraction amount. This technology is called a soft reduction method. In such a soft reduction method, when withdrawing a cast piece using a plurality of pairs of cast piece support rolls arranged in a casting direction, the cast piece is gradually reduced by a reduction amount corresponding to the sum of the solidification contraction amount and the thermal contraction amount so as to reduce the volume of the unsolidified layer and thereby prevent the formation of a void and a negative pressure portion at the center part of the cast piece. Adopting such a mechanism (soft reduction method) can prevent the concentrated molten steel between dendrites from being suctioned from between the dendrites to the center part in the thickness of the cast piece, thus mitigating the center segregation occurring inside the cast piece.

It is known that there is a close relationship between the form of the dendrite structure at the center part in the thickness and the center segregation. For example, Patent Literature 3 proposes a technology in which a specific water volume at a specific position in a casting direction of a secondary cooling zone of a continuous casting machine is set to 0.5 L/kg-steel or higher to promote refinement and equiaxed crystallization of a solidified structure and thereby reduce the center segregation. Further, Patent Literature 4 proposes a technology in which reduction conditions and cooling conditions are appropriately adjusted such that the interval between primary arms of dendrites at a center part in the thickness of a cast piece becomes 1.6 mm or shorter to thereby reduce the center segregation.

On the other hand, while this is a technology aimed at preventing surface cracking of a cast piece, Patent Literature 5 proposes a technology that raises the temperature of the surface of a cast piece by heating as means for temperature control of the cast piece in a continuous casting machine. In the technology proposed in Patent Literature 5, the temperature of a surface layer of the cast piece is raised at an average rate of 30° C./min or more in a straightening zone of the continuous casting machine to thereby prevent surface cracking during straightening of the cast piece.

CITATION LIST

Patent Literature

Patent Literature 1: Japanese Patent Laid-Open No. 08-132203

Patent Literature 2: Japanese Patent Laid-Open No. 08-192256

Patent Literature 3: Japanese Patent Laid-Open No. 08-224650

Patent Literature 4: Japanese Patent Laid-Open No. 2016-28827

Patent Literature 5: Japanese Patent Laid-Open No. 2008-100249

SUMMARY OF INVENTION

Technical Problem

According to the inventions described in Patent Literature 1 and Patent Literature 2, adopting the soft reduction method can reduce the center segregation. However, these technologies are not adequate as methods for reducing the center segregation to such a degree that a quality level as required in recent years for steel pipes, such as line pipes, is achieved.

According to the inventions described in Patent Literature 3 and Patent Literature 4, in addition to adopting the soft reduction method, adjusting the secondary cooling conditions can refine the solidified structure and reduce the center segregation. However, as the level of reduction of segregation required for steel pipes, such as line pipe materials, has been rising year by year, it is still not adequate for reducing the degree of segregation to such a level as will be required in future. To further reduce the segregation, for example, continuously casting steel under optimal soft reduction conditions is conceivable, but it is difficult for the methods of Patent Literature 3 and Patent Literature 4 to reduce the center segregation to lower than the current level.

The cast piece heating device of Patent Literature 5 is limited in terms of installation space in the continuous casting machine. Thus, while this device can be used as local heating means, it does not go so far as to control the entire cast piece to a uniform temperature.

The present invention is a method developed in view of the above-described problems with the conventional technologies, and an object thereof is to propose a new steel continuous casting method that can effectively reduce the center segregation occurring inside a cast piece.

Solution to Problem

To this end, the present inventors vigorously conducted studies to solve the above-described problems with the conventional technologies. As a result, we found that in a cast piece cooling step in steel continuous casting, cooling the cast piece at a preferable water volume density in a specific section can substantially reduce the center segregation inside the cast piece, which led us to develop the present invention.

The present invention has been made based on this finding, and the essential configuration thereof is as follows:

A steel continuous casting method characterized in that cooling of a cast piece is performed at a water volume density per surface area of the cast piece in a first section set within a range of 50 L/($m^2$×min) to 2000 L/($m^2$×min), inclusive, the first section being a range along a cast piece withdrawing direction in a continuous casting machine, from a start point at which an average value of a solid phase ratio along a thickness direction at a final solidified part in a cast piece width direction is 0.8 or lower to an end point at which the average value of the solid phase ratio along the thickness direction at the final solidified part in the cast piece width direction is higher than the solid phase ratio at the start point but not higher than 1.0.

Adopting embodiments as follows adds more preferable aspects to the above-described present invention:

(1) Cooling of the cast piece is performed with the water volume density per surface area of the cast piece in a second section set within a range of 50 L/($m^2$×min) to 300 L/($m^2$×min), inclusive, the second section being a section which is located downstream of the first section and in which the average value of the solid phase ratio in the width direction at the end point is 1.0 or less.

(2) At least after the first section ends and while the second section is passed through, casting is performed so as to maintain a nucleate boiling state in which a surface temperature of the cast piece is 200° C. or lower, and a temperature gradient near a center in a thickness of the cast piece at a last solidification stage is set to 1.7 to 3.5 K/mm.

(3) The first section and the second section are each set inside a region restricted to a horizontal segment or a vertical segment in the continuous casting machine.

(4) In the first section and the second section, soft reduction is applied, and the cast piece is reduced from long-side surfaces at a reduction rate of 0.3 to 2.0 mm/min.

(5) A roll gap of a plurality of pairs of cast piece support rolls is incrementally increased toward a downstream side in a casting direction so as to bulge long-side surfaces of the cast piece by a total bulging amount of 2 to 20 mm, and then the roll gap of the plurality of pairs of cast piece support rolls is incrementally decreased toward the downstream side in the casting direction so as to softly reduce the cast piece.

Advantageous Effects of Invention

Adopting the steel continuous casting method according to the present invention having the above-described essential configuration makes it possible to effectively cool a continuously cast piece and to reduce center segregation and internal cracking that are expected to occur inside the continuously cast piece.

DESCRIPTION OF EMBODIMENTS

Figure 1:
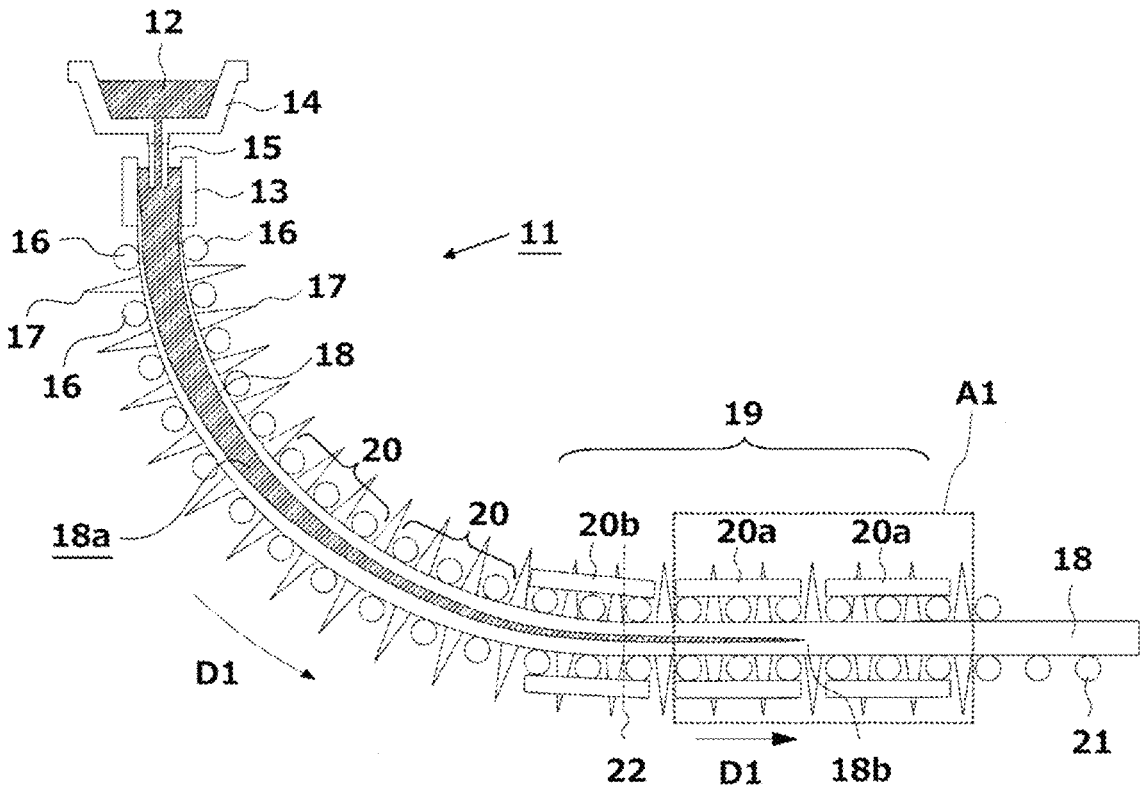
FIG. 1 is a schematic view showing one example of a continuous casting machine that is effective for implementing a steel continuous casting method according to the present invention.

A preferred embodiment of the present invention will be described below with reference to the drawings. However, the scope of the present invention is not limited to the example shown in the drawings.

FIG. 1 is a schematic view showing one example of a continuous casting machine that is effective for implementing a steel continuous casting method according to the present invention. A continuous casting machine 11 shown in FIG. 1 is an example of a vertically bent-type continuous casting machine. In the present invention, instead of a vertically bent type, a curved-type or completely vertical-type continuous casting machine can also be used.

The continuous casting machine 11 shown in FIG. 1 includes a casting mold 13, a tundish 14, a plurality of pairs of cast piece support rolls 16, a plurality of spray nozzles 17, etc. As shown in FIG. 1, a cast piece 18 is withdrawn in a cast piece withdrawing direction D1. In FIG. 1, the side of the tundish 14 along the cast piece withdrawing direction D1 and the side toward which the cast piece 18 is withdrawn will be referred to as an upstream side and a downstream side, respectively, for the following description.

The tundish 14 is provided above the casting mold 13 and serves to supply molten steel 12 to the casting mold 13.

Inside the tundish 14, the molten steel 12 supplied from a ladle (not shown) is stored. For this purpose, at the bottom of the tundish 14, a sliding nozzle (not shown) for adjusting the flow rate of the molten steel 12 is installed, and an immersion nozzle 15 is installed on a lower surface of the sliding nozzle.

The casting mold 13 for continuous casting is installed under the tundish 14, and the molten steel 12 is poured into the casting mold 13 from the tundish 14 through the immersion nozzle 15. The poured molten steel 12 is cooled in the casting mold 13 (primary cooling) and thereby the shape of an outer shell of the cast piece 18 is formed.

As shown in FIG. 1, the plurality of pairs of cast piece support rolls 16 is provided along the cast piece withdrawing direction D1 so as to support the cast piece 18 from both sides. These cast piece support rolls 16 in plurality of pairs are composed of pluralities of pairs of support rolls, for example, support roll pairs, guide roll pairs, and pinch roll pairs. As shown in FIG. 1, a plurality of pairs of cast piece support rolls 16 aggregates to form one segment 20.

The plurality of spray nozzles 17 is each provided between adjacent cast piece support rolls 16 along the cast piece withdrawing direction D1. These spray nozzles 17 are nozzles for performing secondary cooling of the cast piece 18 by spraying cooling water toward the cast piece 18. As these spray nozzles 17, nozzles such as water spray nozzles (one-fluid spray nozzles) or air mist spray nozzles (two-fluid spray nozzles) can be used.

The cast piece 18 is withdrawn along the cast piece withdrawing direction D1 while being cooled with the cooling water (secondary cooling water) sprayed from the plurality of spray nozzles 17. In FIG. 1, an unsolidified part 18*a* of the molten steel inside the cast piece 18 is indicated by hatching. In FIG. 1, a solidification completion position at which the unsolidified part 18*a* disappears and solidification is completed is indicated by reference sign 18*b*.

A downstream-side part of the continuous casting machine 11 is a soft reduction zone 19 in which the cast piece 18 is softly reduced. In this soft reduction zone 19, a plurality of segments 20*a*, 20*b* each formed by a plurality of pairs of cast piece support rolls 16 is provided. The plurality of cast piece support rolls 16 in the soft reduction zone 19 is disposed such that a roll interval in a thickness direction of the cast piece 18 between each pair of rolls becomes gradually narrower toward the cast piece withdrawing direction D1. Thus, the cast piece 18 passing through the soft reduction zone 19 is softly reduced. Reference sign 22 in FIG. 1 indicates a lower straightening position provided inside the region of the soft reduction zone 19.

The above-described downstream-side part of the continuous casting machine 11 is also a horizontal-zone region Al in which the cast piece 18 is carried in a horizontal direction. In FIG. 1, of the segments each composed of the cast piece support rolls 16, segments present in the horizontal-zone region A1 are indicated by reference sign 20*a*, and a segment located on the upstream side of the horizontal-zone region A1 is indicated by reference sign 20*b*.

On the downstream side of the above-described horizontal-zone region A1, a plurality of conveyance rolls 21 for conveying the completely solidified cast piece 18 is provided. Above these conveyance rolls 21, a cast piece cutting machine (not shown) that cuts the cast piece 18 into predetermined lengths is provided.

In the present invention, a first section is specified as a section, along the cast piece withdrawing direction D1 in the continuous casting machine 11, from a start point at which an average value of a solid phase ratio along the thickness direction at a width-direction final solidified part at which the solid phase ratio is the lowest in the cast piece width direction is 0.8 or lower, particularly within a range of 0.1 to 0.8, inclusive, to an end point at which the average value of the solid phase ratio along the thickness direction at the width-direction final solidified part at which the solid phase ratio is the lowest in the cast piece width direction is higher than the average value of the solid phase ratio at the start point and within a range not higher than 1.0.

Here, the solid phase ratio is an index representing a progress status of solidification and expressed in a range of 0 to 1.0, with solid phase ratio=0 (zero) representing being unsolidified and solid phase ratio=1.0 representing being completely solidified.

In the present invention, a section following the above-described first section is specified as a second section, and this second section is a section in which a surface temperature state (nucleate boiling state) after cooling in the first section is complemented until a central solid phase ratio becomes 1.0.

In the steel continuous casting method according to the present invention, cooling of the cast piece is performed in the above-described first section by spraying water that is sprayed from the water spray nozzles. In this process, the water volume density per surface area of the cast piece is set within a range of 50 L/($m^2$×min) to 2000 L/($m^2$×min), inclusive. Performing such cooling substantially increases the temperature gradient at the center part in the thickness of the cast piece, so that the solidified structure at the center part in the thickness of the cast piece can be refined to efficiently reduce the center segregation. Here, cooling the cast piece with cooling water with the water volume density per surface area of the cast piece set within a range of 50 L/($m^2$×min) to 2000 L/($m^2$×min), inclusive, in the first section will be referred to as "intense cooling."

In the following, the thickness direction of the width-direction final solidified part at which the solid phase ratio is the lowest in the cast piece width direction will be described using FIG. 2 and FIG. 3.

Figure 2:
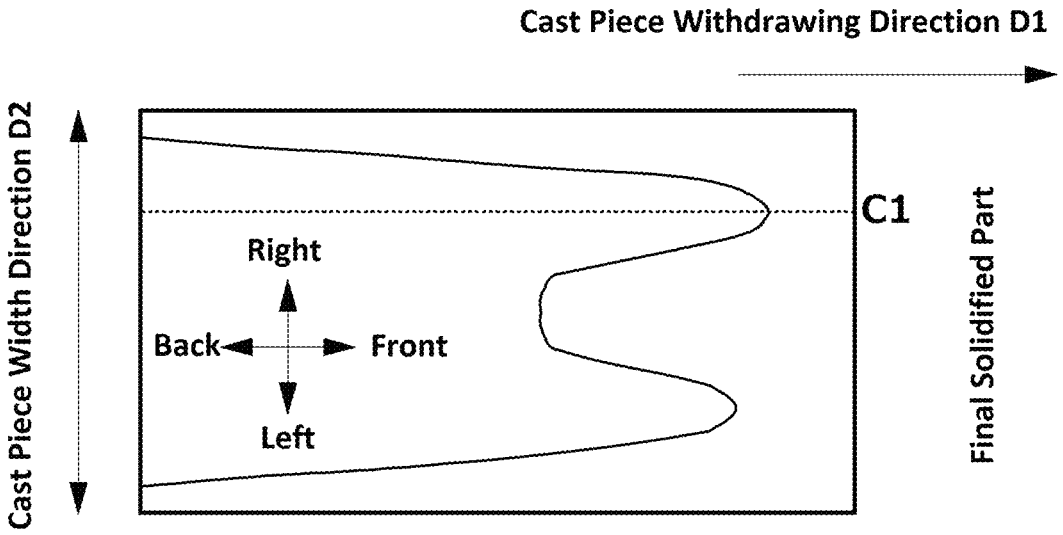
FIG. 2 is a view illustrating a position of final solidification in a cast piece width direction.

FIG. 2 is a view in which the position of the width-direction final solidified part at which the solid phase ratio is the lowest in the cast piece width direction is denoted by C1. FIG. 2 shows a plan view of the cast piece 18 in the case where an upper surface and a lower surface of the cast piece 18 are supported by the cast piece support rolls 16. In FIG. 2, the direction of "BACK←→FRONT" corresponds to the cast piece withdrawing direction D1, and the direction of "RIGHT←→LEFT" corresponds to a width direction D2 of the cast piece 18. The position C1 of the width-direction final solidified part at which the solid phase ratio is the lowest in the cast piece width direction is located along the cast piece withdrawing direction D1 at a position close to the center part in the width direction of the cast piece 18.

Figure 3:
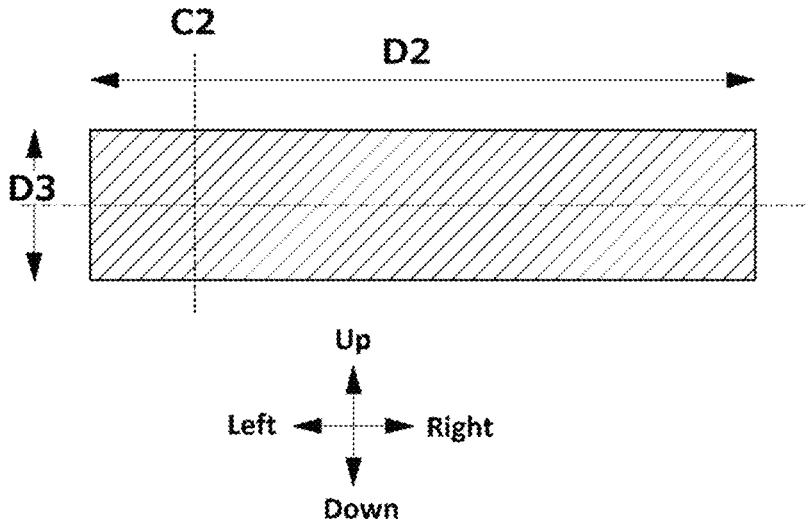
FIG. 3 is a lateral sectional view of a cast piece cut along a plane perpendicular to a cast piece withdrawing direction.

FIG. 3 is a lateral sectional view of the cast piece 18 cut along a plane perpendicular to the cast piece withdrawing direction D1. In FIG. 3, the direction of "LEFT←→RIGHT" corresponds to the width direction D2 of the cast piece 18, and the direction of "UP←→DOWN" corresponds to a thickness direction D3 of the cast piece 18. A position C2 in the thickness direction of the width-direction final solidified part at which the solid phase ratio is the lowest in the cast piece width direction is, in the lateral cross-section of the cast piece 18, a position parallel to the thickness direction D3 at C1 and indicated by the broken line in FIG. 3.

In the following description, a regression formula is used for a coefficient of heat transfer of cooling from the surface of the cast piece by water spraying, and for other steelrelated physical values, physical values corresponding to the respective temperatures from a data book are used, and at each of temperatures for which data is not available, values obtained by performing a proportional calculation using data at temperatures immediately below and immediately above that temperature were used.

In the following description, values described in, for example, Publication 2 (Masashi Mitsuzuka, Tetsu-to-Hagane, Vol. 91, 2005, p. 685 to 693, the Iron and Steel Institute of Japan) and Publication 3 (Toshio Teshima et al., Tetsu-to-Hagane, Vol. 74, 1988, p. 1282 to 1289, the Iron and Steel Institute of Japan) are used for the coefficient of heat transfer in the surface of the cast piece by water spraying.

In the present invention, a cross-sectional temperature distribution of the cast piece was obtained by performing a non-steady heat transfer and solidification analysis based on the premise as described above.

The solid phase ratio at a certain position optionally selected in the thickness direction of the cross-section of the cast piece can be calculated using a temperature at the optionally selected position, a solidus-line temperature of the molten steel, and a liquidus-line temperature of the molten steel, and the temperature at the optionally selected position was determined using the aforementioned cross-sectional temperature distribution of the cast piece. When the temperature at the position is not higher than the solidus-line temperature of the molten steel, the solid phase ratio is 1.0, and when the temperature at the position is not lower than the liquidus-line temperature of the molten steel, the solid phase ratio is 0. When the temperature at the position is higher than the solidus-line temperature of the molten steel and lower than the liquidus-line temperature of the molten steel, the solid phase ratio is a value more than 0 but less than 1.0, and is determined by the temperature at the position.

From the solid phase ratios at the respective positions in the cast piece thickness direction thus calculated, an average value of the solid phase ratio along the thickness direction was obtained.

As described above, in the steel continuous casting method according to the present invention, the water volume density per surface area of the cast piece is set within a range of 50 L/($m^2$×min) to 2000 L/($m^2$×min), inclusive, in the first section. To more efficiently achieve the segregation reducing effect, the water volume density per surface area of the cast piece in this first section is more preferably set to 300 L/($m^2$×min) or more. According to a finding of the present inventors, neither of the temperature gradient at the last solidification stage and the number of segregated grains was found to differ significantly between when the water volume density per surface area of the cast piece in the first section was set to 2000 L/($m^2$×min) and when it was set to 1000 L/($m^2$×min). Since setting the water volume density lower can reduce the required water volume and thereby cut the cost, setting the water volume density to 1000 L/($m^2$×min) or less is desirable.

As to cooling in the first section, while the effect of the present invention can be achieved when the cast piece is cooled at the above-described water volume density complying with the present invention, from the viewpoint of effectively achieving the effect of the present invention by increasing the distance over which cooling is performed at that water volume density, the difference in the average value of the solid phase ratio between the start point and the end point is preferably 0.2 or more, and more preferably 0.4 or more.

Next, it is preferable that in the continuous casting machine, the start point of the first section be located either in the horizontal zone in which the cast piece is conveyed in the horizontal direction or in the curved zone that is located on the upstream side of the horizontal zone. For example, it is preferable that in the continuous casting machine, the first section be within the horizontal-zone region Al in which the cast piece is conveyed in the horizontal direction. This is because when intense cooling is performed in the horizontal-zone region, the cast piece can be evenly cooled so as to mitigate the influence of thermal stress, which makes internal cracking of the cast piece even less likely to occur.

On the other hand, the effect of the present invention can be achieved also when the start point of the first section is in the curved zone. While it is possible that straightening may become impossible due to a decrease in temperature or a problem such as cracking due to surface stress may occur, the case where the start point of the first section is located in the curved zone falls within an allowable range of the present invention.

Next, as to cooling in the second section, the water volume density per surface area of the cast piece should be lower than the water volume density per surface area of the cast piece in the first section, and the flow rate should be such that the surface temperature of the cast piece can be held at 200° C. or lower. This is because cooling at a water volume density equivalent to that in the first section is expensive in terms of equipment. However, doing as specified above can keep the equipment investment cost down and yet achieve an effect equivalent to that when intense cooling is performed only in the first section. In addition, another effect is achieved in that rapid heat recuperation is restricted to prevent internal cracking of the cast piece due to heat recuperation.

From the viewpoint of achieving the above-described effect, it is preferable that the cast piece be cooled in the second section by water spraying with the water volume density per surface area of the cast piece set within a range of 50 L/($m^2$×min) to 300 L/($m^2$×min), inclusive.

The surface temperature of the cast piece refers to a temperature at the center position in the width of an outermost surface of the cast piece in the aforementioned cross-sectional temperature distribution of the cast piece obtained by the non-steady heat transfer and solidification analysis. While this calculated value is used as the surface temperature in the present invention, the surface temperature of the cast piece can also be actually measured. When actually measuring the surface temperature, the temperature of the outermost surface of the cast piece is measured as the surface temperature using, for example, a radiation thermometer or a thermocouple.

Further, as to materials subject to strict center segregation requirements, it is preferable that the cast piece is softly reduced from long-side surfaces at a reduction rate of 0.3 to 2.0 mm/min in the first section and the second section. This is because doing so can restrict suctioning of the concentrated molten steel due to solidification contraction. In the present invention, it is also possible to further reduce the center segregation by combining intense cooling and soft reduction.

The roll gap of the plurality of pairs of cast piece support rolls is incrementally increased toward the downstream side within a range not including a straightening point (starting at or after upper straightening and ending before lower straightening, and the degree is set flat at the straightening point so as not to change the constriction as far as possible) so as to bulge the long-side surfaces of the cast piece by a total bulging amount of 2 to 20 mm, and then the roll gap of the plurality of pairs of cast piece support rolls is incrementally reduced toward the downstream side in the casting direction so as to softly reduce the cast piece by such a total amount that it is not reduced beyond thermal contraction of the short sides. Thus, a further improvement in efficiency can be expected.

An experiment on requirements for reducing the center segregation, i.e., conditions of implementation for reducing the center segregation was conducted as follows.

In this experiment, using the vertically bent-type continuous casting machine shown in FIG. 1, medium-carbon aluminum killed steel was cast. The machine length of the continuous casting machine was 49 m; the thickness of a cast piece was 250 mm; the width of the cast piece was 2100 mm; secondary cooling was performed using air mist spraying except for the first section and the second section; and the range of the second cooling was from immediately under the casting mold to the outlet of the continuous casting machine. The concentrations of ingredient components in the medium-carbon aluminum killed steel used are as follows: carbon (C): 0.20 mass %, silicon (Si): 0.25 mass %, manganese (Mn): 1.1 mass %, phosphorous (P): 0.01 mass %, and sulfur (S): 0.002 mass %.

In this experiment, the solidification completion position of the cast piece and the temperature gradient near the center in the thickness at the last solidification stage are defined as described below. For the number of segregated grains, the internal crack length, and the cutting of the cast piece, those measured as follows were used, and were used for evaluations of the degree of segregation, the internal cracking, and the cutting, respectively. Here, "cutting" refers to a void in a cast piece that appears as molten steel which remains in a closed space between dendrites during solidification and in which segregation components have concentrated contracts in volume during solidification.

<Solidification Completion Position>

The solidification completion position of the cast piece was calculated by a non-steady heat transfer and solidification analysis.

<Temperature Gradient Near Center in Thickness of Cast Piece at Last Solidification Stage>

The temperature gradient near the center in the thickness of the cast piece at the last solidification stage was calculated using the aforementioned non-steady heat transfer and solidification analysis.

In this analysis, in a cross-section of the cast piece 1 m upstream in the cast piece withdrawing direction D1 from the solidification completion position, an average temperature of a region within a range of 1 mm in the thickness direction and 10 mm in the width direction from the center position of the cast piece was calculated. Next, in the cross-section of the cast piece 1 m upstream in the cast piece withdrawing direction D1 from the solidification completion position, an average temperature in a region within a range of ±1 mm in the thickness direction and 10 mm in the width direction that was centered at a position 10 mm from the center position of the cast piece in the thickness direction was calculated. A value obtained by dividing the difference between these two average temperatures by 10 mm was used as the temperature gradient (K/mm) near the center in the thickness of the cast piece at the last solidification stage.

<Number of Segregated Grains>

The number of segregated grains was measured by the following method and used for the evaluation of segregation.

From a cross-section of the cast piece perpendicular to the cast piece withdrawing direction D1, a cast piece sample was taken that had a width of 15 mm, included a center segregation part at its center part, and had a length from the center in the width to a triple point (a point at which solidification shells on the short-edge side and the long-edge side that have grown met) on one side. A cross-section perpendicular to the cast piece withdrawing direction D1 of the cast piece sample taken was ground, and a segregation zone was revealed by, for example, corroding the surface with a saturated aqueous solution of picric acid etc., and a range of ±7.5 mm in the thickness of the cast piece from the center of this segregation zone was regarded as a center segregation part. The cast piece sample in the segregation zone near the center in the thickness (near the solidification completion part) was divided into small parts in the cast piece width direction, and then the concentration of manganese (Mn) in the cast piece samples was surface analyzed over the entire surface using an electron probe micro analyzer (EPMA), with an electron beam diameter of 100 μm. A distribution of the degree of segregation of manganese (Mn) was obtained, and regions with a degree of Mn segregation of 1.33 or higher that are connected were regarded as one segregated grain. The number of segregated grains was counted, and the number of segregated grains divided by the length of the sample in the cast piece width direction was regarded as the number of segregated grains (piece/mm). Here, the degree of Mn segregation is the Mn concentration at the segregation part divided by the Mn concentration at a position 10 mm away from the center part in the thickness.

<Internal Crack Length of Cast Piece>

The internal crack length of the cast piece was measured by the following method and used for the evaluation of internal cracking.

In the cast piece after casting, a cross-section of the cast piece perpendicular to the cast piece withdrawing direction D1 was observed, and the lengths of internal cracks along the cast piece thickness direction were measured. Of these lengths of the internal cracks, the largest length in the observed cross-section was regarded as the internal crack length (mm). When no internal cracks were recognized, the internal crack length was regarded as 0.

<Determination of Cutting>

The cross-section of the cast piece after completion of solidification perpendicular to the cast piece withdrawing direction D1 was subjected to milling and then hydrochloric acid etching. Then, a macro print was taken and checked for cutting by a visual sensory inspection. A cross-section in which no cutting was recognized were determined as "good" (circle), and a cross-section in which slight cutting that did not affect the product quality were determined as "fair" (triangle).

The present inventors conducted the following experiments to study the conditions for reducing the center segregation.

[Experiment 1]

Figure 4:
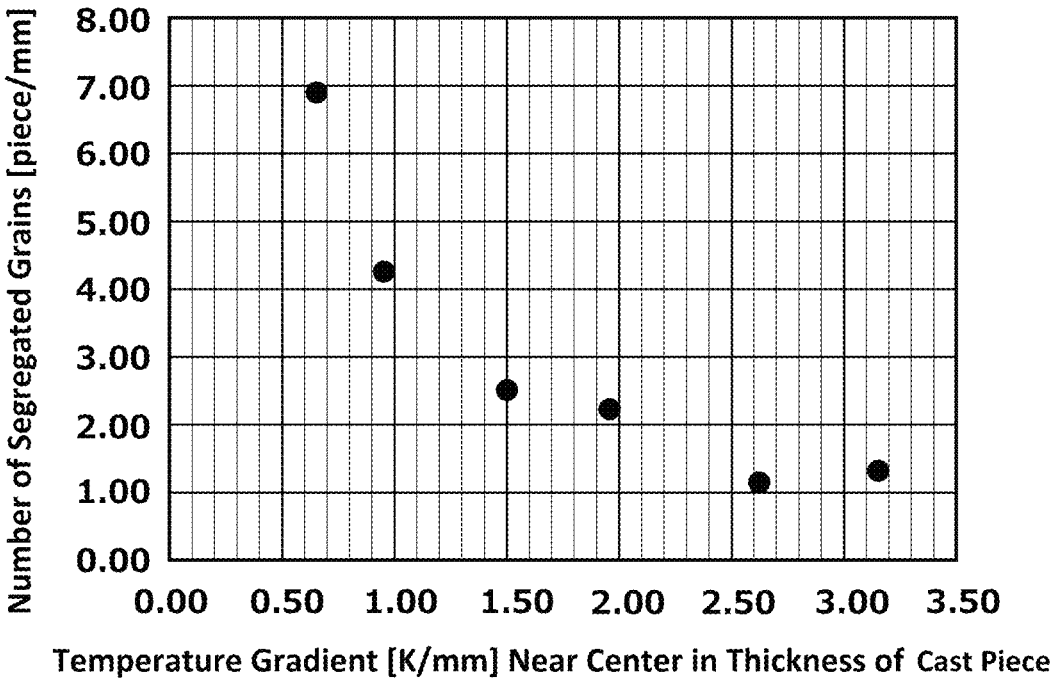
FIG. 4 is a graph showing a relationship between a temperature gradient near a center in a thickness of a cast piece and a number of segregated grains in Experiment 1.

In this experiment, the temperature gradient near the center in the thickness of a cast piece at the last solidification stage of the cast piece and the number of segregated grains were calculated or measured by the above-described methods, and the relationship therebetween was examined. A graph on which the result is plotted is shown in FIG. 4. From the result shown in FIG. 4, it was learned that when the temperature gradient (K/mm) near the center in the thickness of the cast piece at the last solidification stage was increased, the number of segregated grains decreased and the center segregation tended to be reduced. The temperature gradient near the center in the thickness of the cast piece at the last solidification stage should be 1.7 to 3.5, more preferably 2.0 to 3.5. A possible reason why center segregation can be reduced is that increasing the temperature gradient can refine the solidified structure at the center part in the thickness of the cast piece.

[Experiment 2]

In this experiment, a cast piece was manufactured while the condition of the water volume density per surface area of the cast piece in water spraying was varied during secondary cooling of the cast piece using a continuous casting machine, and the relationship between the water volume density and the temperature gradient near the center in the thickness of the cast piece at the last solidification stage was studied. An optimal range of the water volume density for achieving a temperature gradient at the center part in the thickness of the cast piece that could reduce the center segregation was also studied. A graph on which the result is plotted is shown in FIG. 5.

Figure 5:
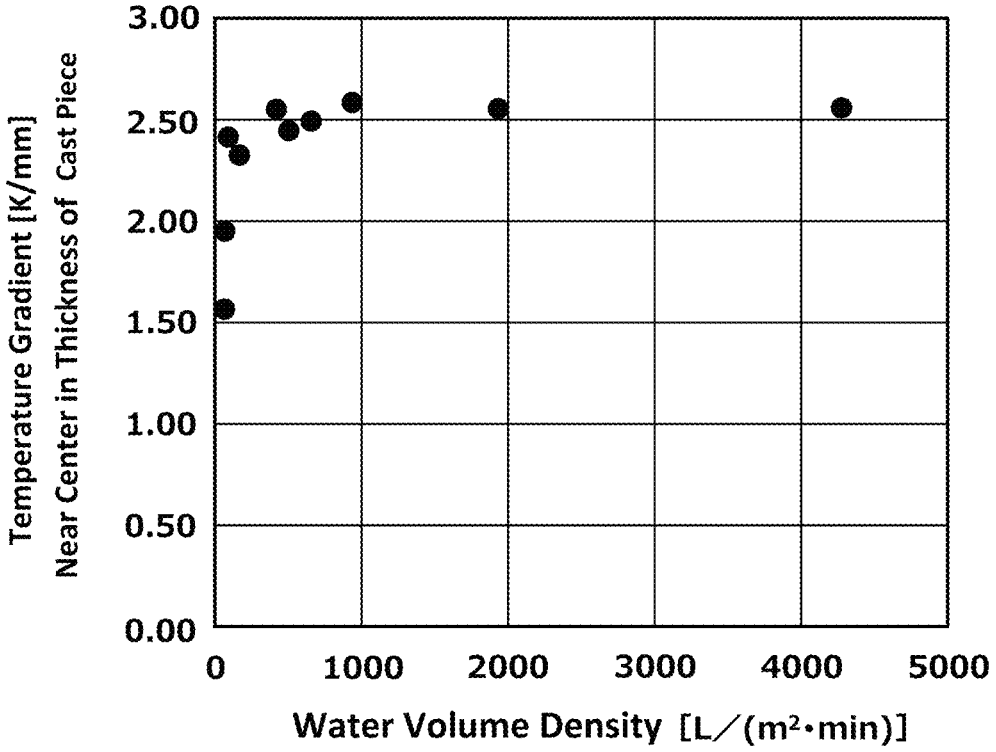
FIG. 5 is a graph showing a relationship between a water volume density and the temperature gradient near the center in the thickness of the cast piece in Experiment 2.

From the result shown in FIG. 5, it was learned that when the water volume density per surface area of the cast piece was 50 L/($m^2$×min) or more, the temperature gradient at the center part in the thickness of the cast piece became substantially larger. Thus, it can be seen that, based on the result of Experiment 1 described above, the center segregation can be substantially reduced by performing cooling with the water volume density per surface area of the cast piece set to 50 L/($m^2$×min) or more. Even when the water volume density per surface area of the cast piece was set to 1000 L/($m^2$×min) or more, the temperature gradient at the center part in the thickness of the cast piece did not become larger.

Thus, although this varies slightly between the first section and the second section, to efficiently increase the temperature gradient at the center part in the thickness of the cast piece, the water volume density per surface area of the cast piece should be set to 2000 L/($m^2$×min) or less, preferably 1000 L/($m^2$×min) or less. The lower limit should be 50 L/($m^2$×min) or more, preferably 300 L/($m^2$×min) or more.

[Experiment 3]

In this experiment, the effect of cooling the cast piece was studied. According to a finding of the present inventors, the effect of cooling the cast piece was found to be significantly influenced by the surface temperature of the cast piece. A possible explanation is that the form of boiling of cooling water varies according to the surface temperature of the cast piece. If the surface temperature of the cast piece has decreased sufficiently, the form of boiling in a surface layer becomes nucleate boiling, which can achieve stable cooling. Therefore, the condition of the water volume density per surface area of the cast piece in water spraying was varied during secondary cooling of the cast piece using a continuous casting machine, and the time taken for the surface temperature of the cast piece to decrease from 800° C. to 300° C. (temperature decrease time) was calculated to study the influence of the water volume density on the temperature decrease time. A graph on which the result is plotted is shown in FIG. 6.

Figure 6:
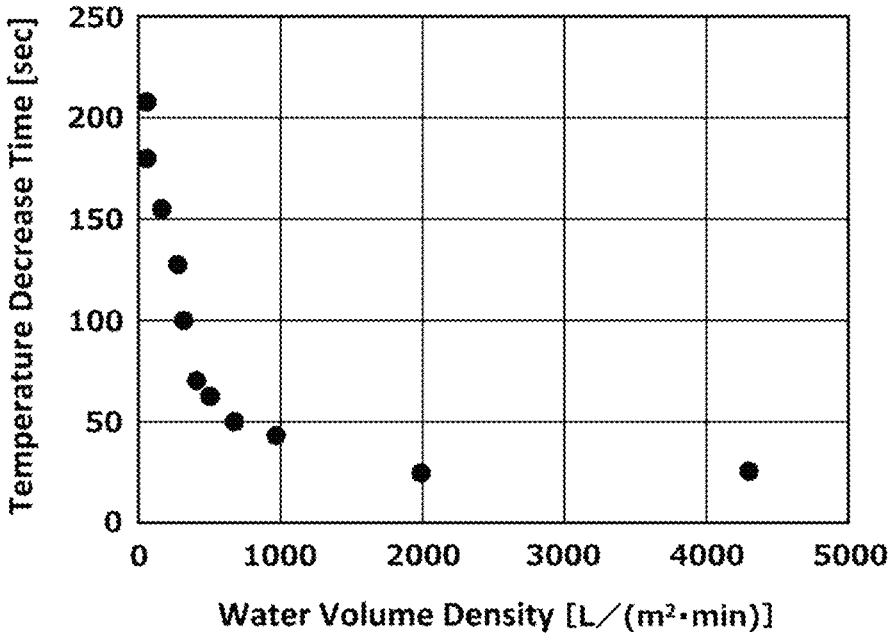
FIG. 6 is a graph showing a relationship between the water volume density and a temperature decrease time in Experiment 3.

From the result shown in FIG. 6, it was learned that the temperature decrease time for the surface temperature of the cast piece to decrease from 800° C. to 300° C. was less than 200 seconds when the water volume density per surface area of the cast piece was near 50 L/($m^2$×min), and that therefore a water volume density per surface area of the cast piece of 50 L/($m^2$×min) or more was preferable. When the water volume density per surface area of the cast piece was more than 2000 L/($m^2$×min), the decrease time did not change significantly.

Therefore, from the viewpoint of efficient cooling, it was learned that setting the water volume density per surface area of the cast piece, particularly in the first section, to 2000 L/($m^2$×min) or less, is desirable.

[Experiment 4]

Next, the present inventors also studied the start position of intense cooling that allowed the temperature gradient at the center part in the thickness of the cast piece to be efficiently increased. Using a continuous casting machine, the cast piece was cooled while the condition of the average value of the solid phase ratio along the thickness direction of the cast piece at the start of intense cooling was varied, and a relationship between the average value of the solid phase ratio at the start of intense cooling and the temperature gradient near the center in the thickness of the cast piece at the last solidification stage was studied. The thickness of the cast piece was 250 mm, and the water volume density per surface area of the cast piece during intense cooling was 300 L/($m^2$×min), and the intense cooling was continued up to the complete solidification position of the cast piece. A graph on which the result about the relationship between the average value of the solid phase ratio at the start of intense cooling and the temperature gradient near the center in the thickness of the cast piece at the last solidification stage is plotted is shown in FIG. 7.

Figure 7:
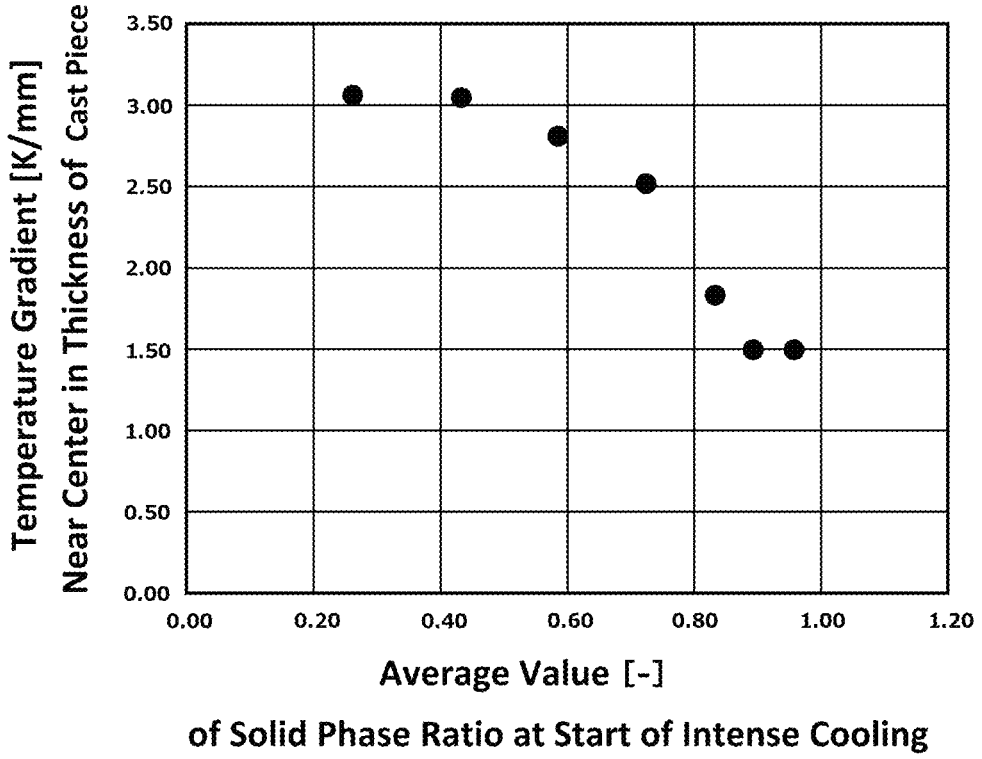
FIG. 7 is a graph showing a relationship between an average value of a solid phase ratio at the start of intense cooling and the temperature gradient near the center in the thickness of the cast piece in Experiment 4.

From the result shown in FIG. 7, it was learned that as the average value of the solid phase ratio at the start of intense cooling became lower, the temperature gradient at the center part of the cast piece tended to become larger. However, the temperature gradient when the average value of the solid phase ratio at the start of intense cooling was 0.26 did not differ significantly from the temperature gradient when the average value of the solid phase ratio at the start of intense cooling was 0.43, and the temperature gradient at the center part of the cast piece was 1.7 or larger when the average value of the solid phase ratio was 0.8. Thus, it was learned that to fully exert the effect of the present invention and to make the equipment for intense cooling more compact so as to increase the efficiency of equipment investment and operation, the average value of the solid phase ratio at the start of intense cooling should be 0.4 or higher. When the average value of the solid phase ratio at the start of intense cooling was higher than 0.9, the temperature gradient did not become larger.

EXAMPLES

In the following, Examples that were implemented to verify the effect of the present invention will be described.

Using the vertically bent-type continuous casting machine shown in FIG. 1, medium-carbon aluminum killed steel was cast. The machine length of the continuous casting machine was 49 m; the thickness of a cast piece was 250 mm; the width of the cast piece was 2100 mm, secondary cooling was performed using air mist spraying except for the first section and the second section; and the range of the second cooling was from immediately under the casting mold to the outlet of the continuous casting machine. The concentrations of ingredient components in the medium-carbon aluminum killed steel used were as follows: carbon (C): 0.20 mass %, silicon (Si): 0.25 mass %, manganese (Mn): 1.1 mass %, phosphorous (P): 0.01 mass %, and sulfur (S): 0.002 mass %.

Example 1

In this Example, a study was conducted with the conditions as shown in Table 1 including the solid phase ratio at the start point and the solid phase ratio at the end point in the "first section"; the water volume density (L/(m$^2$×min)) per surface area of the cast piece; a first-section exit-side surface temperature (° C.); the solid phase ratio at the start point and the solid phase ratio at the end point in the "second section"; the water volume density (L/(m$^2$×min)) per surface area of the cast piece; and a second-section maximum surface temperature (° C.).

Based on the result, the temperature gradient (K/mm) at the last solidification stage, the soft reduction conditions (reduction rate: 0.3 to 2.0 mm/min), and the total bulging amount (mm) were found, and these findings are collectively shown in Table 1. In addition, the number of segregated grains (piece/mm) was found as an evaluation of the degree of segregated grains, and the internal crack length (mm) was found as an evaluation of the internal cracking, and these findings are collectively shown in Table 1. In the tables, an example in which the conditions comply with the present invention is indicated as an invention example, and an example in which the conditions do not comply with the present invention is indicated as a comparative example. In the following tables, for the evaluation of the degree of segregation, numbers of segregated grains not larger than 1.3 piece/mm are evaluated as good and marked with a double circle; those exceeding 1.3 piece/mm but less than 3.5 piece/mm are evaluated as fair and marked with a circle; and those not smaller than 3.5 piece/mm are evaluated as fail and marked with a cross. For the evaluation of the internal cracking, internal crack lengths not longer than 1.0 mm are evaluated as good and marked with a double circle; those exceeding 1.0 mm but less than 10 mm are evaluated as fair and marked with a circle; and those not shorter than 10 mm are evaluated as fail and marked with a cross.

No. 1 to 7 and No. 10 to 14 are all examples in which operation was conducted using the conditions required for operation in the first section that were within the ranges complying with the present invention. As a result, the evaluation of the degree of segregation and the evaluation of the internal cracking were both good. On the other hand, No. 8 shown as a comparative example is an example in which the water volume density in the first section is outside the range, and No. 9 is an example in which the solid phase ratio at the start point is outside the range. In No. 8 with a low water volume density, the nucleate boiling state failed to be maintained, and the evaluation of the number of segregated grains and the evaluation of the internal cracking were both poor. In No. 9 with an out-of-range solid phase ratio, the temperature gradient at the center part of the cast piece was small and the evaluation of the number of segregated grains was poor.

TABLE 1

| | First Section | | | | Second section | | | | Temperature gradient at |
|---|---|---|---|---|---|---|---|---|---|
| No. | Solid phase ratio (start point) | Solid phase ratio (end point) | Water volume density L/(m$^2$ · min) | Surface temp. (exit side) ° C. | Solid phase ratio (start point) | Solid phase ratio (end point) | Water volume density L/(m$^2$ · min) | Surface temp. (Max. value) ° C. | center of cast piece at last solidification stage K/mm |
| 1 | 0.45 | 1.00 | 500 | 180 | 1.00 | 1.00 | 50 | 165 | 3.04 |
| 2 | 0.45 | 1.00 | 2000 | 150 | 1.00 | 1.00 | 300 | 135 | 3.06 |
| 3 | 0.73 | 1.00 | 500 | 164 | 1.00 | 1.00 | 50 | 157 | 2.38 |
| 4 | 0.73 | 1.00 | 2000 | 152 | 1.00 | 1.00 | 300 | 120 | 2.40 |
| 5 | 0.53 | 0.80 | 500 | 195 | 0.80 | 1.00 | 300 | 187 | 2.94 |
| 6 | 0.53 | 0.82 | 2000 | 185 | 0.82 | 1.00 | 300 | 177 | 2.96 |
| 7 | 0.53 | 0.80 | 500 | 185 | 0.80 | 1.00 | 300 | 187 | 2.94 |
| 8 | 0.53 | 0.75 | 45 | 350 | 0.75 | 1.00 | 300 | 295 | 1.22 |
| 9 | 1.00 | 1.00 | 50 | 142 | 1.00 | 1.00 | 50 | 132 | 0.00 |
| 10 | 0.53 | 0.80 | 50 | 190 | 0.80 | 1.00 | 300 | 185 | 3.01 |
| 11 | 0.53 | 0.80 | 300 | 195 | 0.80 | 1.00 | 300 | 182 | 3.16 |
| 12 | 0.62 | 0.75 | 2000 | 150 | 0.75 | 1.00 | 50 | 175 | 2.00 |
| 13 | 0.52 | 0.72 | 2000 | 162 | 0.72 | 1.00 | 50 | 185 | 3.20 |
| 14 | 0.53 | 0.93 | 2000 | 164 | 0.93 | 1.00 | 50 | 189 | 3.10 |

| | Soft reduction conditions | | Evaluation of segregation degree | | Evaluation of internal cracking | | |
|---|---|---|---|---|---|---|---|
| No. | Reduction rate mm/min | Total bulging amount mm | Number of segregated grains piece/mm | Evaluation | Internal crack length mm | Evaluation | Remarks |
| 1 | 0.30 | 2 | 1.26 | ◎ | 0 | ◎ | Invention Example |
| 2 | 0.30 | 2 | 1.25 | ◎ | 0 | ◎ | Invention Example |
| 3 | 0.30 | 2 | 1.49 | ○ | 0 | ◎ | Invention Example |
| 4 | 0.30 | 2 | 1.48 | ○ | 0 | ◎ | Invention Example |
| 5 | 0.30 | 2 | 1.26 | ◎ | 0 | ◎ | Invention Example |
| 6 | 0.30 | 2 | 1.29 | ◎ | 0 | ◎ | Invention Example |
| 7 | 2.00 | 20 | 1.29 | ◎ | 0 | ◎ | Invention Example |
| 8 | 0.30 | 2 | 3.53 | X | 5 | ○ | Comparative Example |
| 9 | 0.30 | 2 | 6.72 | X | 15 | X | Comparative Example |
| 10 | 2.00 | 20 | 1.30 | ◎ | 0 | ◎ | Invention Example |
| 11 | 2.00 | 20 | 1.26 | ◎ | 0 | ◎ | Invention Example |
| 12 | 2.00 | 20 | 1.21 | ◎ | 0 | ◎ | Invention Example |
| 13 | 2.00 | 20 | 1.24 | ◎ | 0 | ◎ | Invention Example |
| 14 | 2.00 | 20 | 1.31 | ◎ | 0 | ◎ | Invention Example |

Example 2

In this Example, the conditions required for the process in the second section in the present invention (the water volume density (L/(m$^2$×min) per surface area of the cast piece)) and the second-section maximum surface temperature (° C.) were studied. That is, in this example, the conditions required for the second section based on the premise of the conditions required for the first section of [Example 1]described above were studied. These conditions and the result are summarized in Table 2. Each evaluation was conducted in the same manner as in [Example 1]. As is clear from Table 2, while No. 20 to 26 meet the conditions of the present invention, No. 27 and 28 fall short of the water volume density per surface area of the cast piece required in the second section. Therefore, although No. 27 and 28 meet the conditions of the present invention required in the first section, the evaluation of the degree of segregation and the evaluation of the internal cracking both turned out to be somewhat poor compared with those in No. 20 to 26.

TABLE 2

| | First Section | | | | Second section | | | | Temperature gradient at |
|---|---|---|---|---|---|---|---|---|---|
| No. | Solid phase ratio (start point) | Solid phase ratio (end point) | Water volume density L/(m$^2$ · min) | Surface temp. (exit side) ° C. | Solid phase ratio (start point) | Solid phase ratio (end point) | Water volume density L/(m$^2$ · min) | Surface temp. (Max. value) ° C. | center of cast piece at last solidification stage K/mm |
| 20 | 0.45 | 1.00 | 500 | 180 | 1.00 | 1.00 | 50 | 165 | 3.04 |
| 21 | 0.45 | 1.00 | 2000 | 150 | 1.00 | 1.00 | 300 | 135 | 3.06 |
| 22 | 0.73 | 1.00 | 500 | 164 | 1.00 | 1.00 | 50 | 157 | 2.38 |
| 23 | 0.73 | 1.00 | 2000 | 152 | 1.00 | 1.00 | 300 | 120 | 2.40 |
| 24 | 0.53 | 0.80 | 500 | 195 | 0.80 | 1.00 | 300 | 187 | 2.94 |
| 25 | 0.53 | 0.82 | 2000 | 185 | 0.82 | 1.00 | 300 | 177 | 2.96 |
| 26 | 0.53 | 0.80 | 500 | 185 | 0.80 | 1.00 | 300 | 187 | 2.94 |
| 27 | 0.53 | 0.80 | 500 | 195 | 0.80 | 1.00 | 30 | 250 | 1.52 |
| 28 | 0.53 | 0.80 | 500 | 195 | 0.80 | 0.90 | 40 | 271 | 1.68 |

| | Soft reduction conditions | | Evaluation of segregation degree | | Evaluation of internal cracking | | |
|---|---|---|---|---|---|---|---|
| No. | Reduction rate mm/min | Total bulging amount mm | Number of segregated grains piece/mm | Evaluation | Internal crack length mm | Evaluation | Remarks |
| 20 | 0.30 | 2 | 1.26 | ◎ | 0 | ◎ | Invention Example |
| 21 | 0.30 | 2 | 1.25 | ◎ | 0 | ◎ | Invention Example |
| 22 | 0.30 | 2 | 1.49 | ○ | 0 | ◎ | Invention Example |
| 23 | 0.30 | 2 | 1.48 | ○ | 0 | ◎ | Invention Example |
| 24 | 0.30 | 2 | 1.26 | ◎ | 0 | ◎ | Invention Example |
| 25 | 0.30 | 2 | 1.29 | ◎ | 0 | ◎ | Invention Example |
| 26 | 2.00 | 20 | 1.29 | ◎ | 5 | ○ | Invention Example |
| 27 | 0.30 | 2 | 2.40 | ○ | 7 | ○ | Invention Example |
| 28 | 0.30 | 2 | 2.38 | ○ | 9 | ○ | Invention Example |

Example 3

In this Example, a study was conducted on examples about the temperature gradient (K/mm) at the center part in the thickness of the cast piece at the last solidification stage, the reduction rate (mm/min) as the soft reduction conditions, and the total bulging amount (mm) based on the premise that the above-described conditions required for the first section and the second section complied with the present invention. These conditions and the result are summarized in Table 3. Each evaluation was conducted in the same manner as in [Example 1]. As is clear from Table 3, in No. 30 to 37 that are all compliant cases as examples of the invention, the evaluation of the degree of segregation and the evaluation of the internal cracking were both generally good. However, in No. 38 and 39, due to a lack of the water volume density in the second section, the temperature gradient (K/mm) near the center in the thickness of the cast piece at the last solidification stage became small, and the second-section maximum surface temperature became high (>200° C.). Thus, No. 38 and 39 were found to fail to produce an effect similar to that of No. 30 to 37.

TABLE 3

| | First Section | | | | Second section | | | | Temperature gradient at |
|---|---|---|---|---|---|---|---|---|---|
| No. | Solid phase ratio (start point) | Solid phase ratio (end point) | Water volume density L/(m$^2$ · min) | Surface temp. (exit side) ° C. | Solid phase ratio (start point) | Solid phase ratio (end point) | Water volume density L/(m$^2$ · min) | Surface temp. (Max. value) ° C. | center of cast piece at last solidification stage K/mm |
| 30 | 0.45 | 1.00 | 500 | 180 | 1.00 | 1.00 | 50 | 165 | 3.04 |
| 31 | 0.45 | 1.00 | 2000 | 150 | 1.00 | 1.00 | 300 | 135 | 3.06 |
| 32 | 0.73 | 1.00 | 500 | 164 | 1.00 | 1.00 | 50 | 157 | 2.38 |
| 33 | 0.73 | 1.00 | 2000 | 152 | 1.00 | 1.00 | 300 | 120 | 2.40 |
| 34 | 0.53 | 0.80 | 500 | 195 | 0.80 | 1.00 | 300 | 187 | 2.94 |
| 35 | 0.53 | 0.82 | 2000 | 185 | 0.82 | 1.00 | 300 | 177 | 2.96 |
| 36 | 0.53 | 0.80 | 500 | 185 | 0.80 | 1.00 | 300 | 187 | 2.94 |
| 37 | 0.53 | 0.80 | 50 | 210 | 0.80 | 0.90 | 250 | 180 | 1.70 |
| 38 | 0.53 | 0.80 | 500 | 195 | 0.80 | 1.00 | 30 | 250 | 1.52 |
| 39 | 0.53 | 0.80 | 500 | 195 | 0.80 | 1.00 | 40 | 271 | 1.68 |

| | Soft reduction conditions | | Evaluation of segregation degree | | Evaluation of internal cracking | | |
|---|---|---|---|---|---|---|---|
| No. | Reduction rate mm/min | Total bulging amount mm | Number of segregated grains piece/mm | Evaluation | Internal crack length mm | Evaluation | Remarks |
| 30 | 0.30 | 2 | 1.26 | ◎ | 0 | ◎ | Invention Example |
| 31 | 0.30 | 2 | 1.25 | ◎ | 0 | ◎ | Invention Example |
| 32 | 0.30 | 2 | 1.49 | ○ | 0 | ◎ | Invention Example |
| 33 | 0.30 | 2 | 1.48 | ○ | 0 | ◎ | Invention Example |
| 34 | 0.30 | 2 | 1.26 | ◎ | 0 | ◎ | Invention Example |
| 35 | 0.30 | 2 | 1.29 | ◎ | 0 | ◎ | Invention Example |
| 36 | 2.00 | 20 | 1.29 | ◎ | 5 | ○ | Invention Example |
| 37 | 0.30 | 15 | 2.31 | ○ | 6 | ○ | Invention Example |
| 38 | 0.30 | 2 | 2.40 | ○ | 7 | ○ | Invention Example |
| 39 | 0.30 | 2 | 2.38 | ○ | 7 | ○ | Invention Example |

From the results of these Examples, it was confirmed that in the present invention, effective cooling of a continuously cast piece could be performed by setting the water volume density per surface area of the cast piece within the predetermined range at least in the first section as a premise, and controlling also the water volume density per surface area of the cast piece in the second section as necessary. It is more desirable to also take the temperature gradient near the center in the thickness of the cast piece at the last solidification stage and the conditions of soft reduction in the first and second sections into account, which was demonstrated to be more effective.

Example 4

Figure 8:
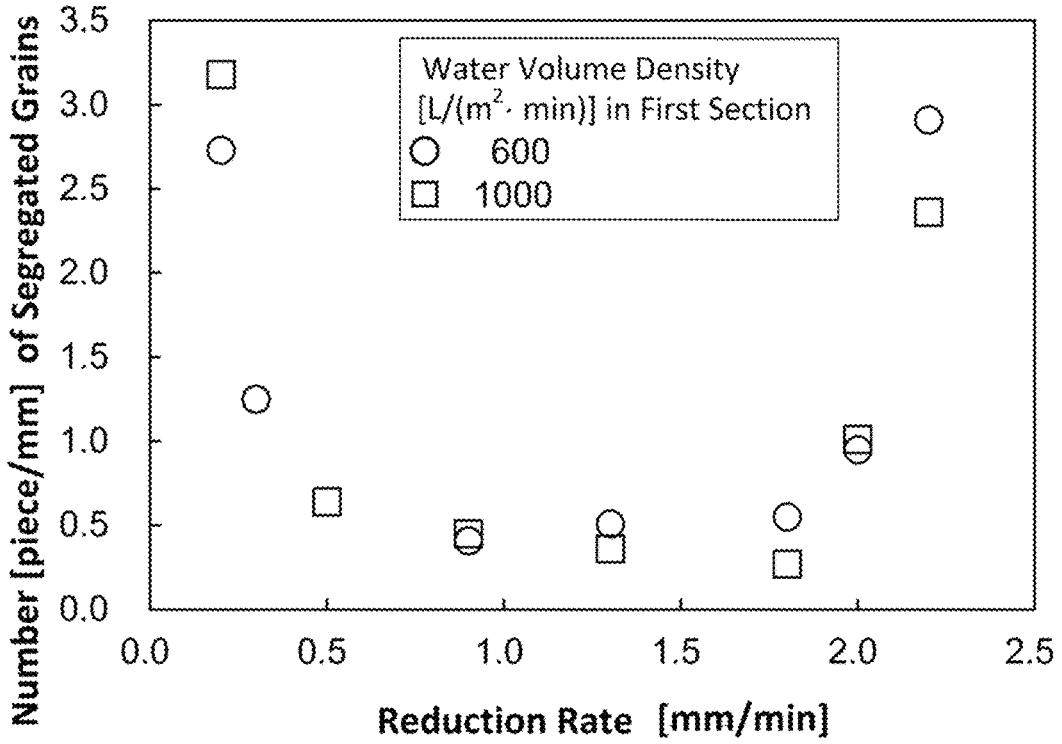
FIG. 8 is a graph showing an influence that intense cooling and a reduction rate during soft reduction have on a degree of segregation.

In this Example, the above-described cooling condition required in the first section was set to a range of more intense cooling, and the cooling condition required in the second section was set to 180 L/(m$^2$×min), while the total bulging amount was held constant. The influence of the reduction rate (mm/min) as the soft reduction condition was studied. These conditions and the result are summarized in Table 4, and the relationship between the reduction rate during soft reduction and the degree of segregation is shown in FIG. 8. Each evaluation was conducted in the same manner as in [Example 1]. As to the determination of cutting, cases where no cutting was recognized were determined as good (circle), and cases where slight cutting that did not affect the product quality was recognized were determined as fair (triangle). As is clear from Table 4, in No. 41 to 45 and 48 to 52 that are all compliant cases as the invention examples, the evaluation of the degree of segregation and the evaluation of cutting were both generally good. However, as to No. 40 and 47, due to the reduction rate as the soft reduction conditions being too low, the number of segregated grains became larger than that in No. 41 to 45 and 48 to 52, and slight cutting was found. On the other hand, as to No. 46 and 53, due to the reduction rate as the soft reduction conditions being too high, the number of segregated grains became larger than that in No. 41 to 45 and 48 to 52. Under the conditions of Table 4, no internal cracking occurred. From this result, as shown in FIG. 8, it was demonstrated that a cast piece excellent in the evaluations of the degree of segregation, the internal cracking, and the determination of cutting could be manufactured by setting the cooling condition for the first section to a range of more intense cooling and setting the reduction rate as the soft reduction conditions to 0.3 to 2.0 mm/min.

A possible cause is as follows. When super-intense cooling of the cast piece is applied in an unsolidified region, the temperature gradient increases and refinement of dendrites can be achieved. To further improve the center segregation, combining soft reduction is preferable. However, if soft reduction is too weak, i.e., the reduction rate is too low, a flow accompanying solidification contraction cannot be inhibited and normal segregation occurs. In addition, cutting due to solidification contraction may occur. Conversely, if soft reduction is too strong, i.e., the reduction rate is too fast, reduction becomes excessive, so that concentrated molten steel flows backward and causes inverted-V segregation, thus exacerbating the segregation.

TABLE 4

| No. | First Section: Solid phase ratio (start point) | First Section: Solid phase ratio (end point) | First Section: Water volume density L/(m$^2$ · min) | First Section: Surface temp. (exit side) ° C. | Second section: Solid phase ratio (start point) | Second section: Solid phase ratio (end point) | Second section: Water volume density L/(m$^2$ · min) | Second section: Surface temp. (Max. value) ° C. | Temperature gradient at center of cast piece at last solidification stage K/mm |
|---|---|---|---|---|---|---|---|---|---|
| 40 | 0.45 | 0.80 | 600 | 175 | 0.80 | 1.00 | 180 | 185 | 2.60 |
| 41 | 0.45 | 0.80 | 600 | 173 | 0.80 | 1.00 | 180 | 183 | 2.61 |
| 42 | 0.45 | 0.80 | 600 | 175 | 0.80 | 1.00 | 180 | 182 | 2.65 |
| 43 | 0.45 | 0.80 | 600 | 176 | 0.80 | 1.00 | 180 | 188 | 2.61 |
| 44 | 0.45 | 0.80 | 600 | 174 | 0.80 | 1.00 | 180 | 187 | 2.58 |
| 45 | 0.45 | 0.80 | 600 | 174 | 0.80 | 1.00 | 180 | 187 | 2.58 |
| 46 | 0.45 | 0.80 | 600 | 172 | 0.80 | 1.00 | 180 | 185 | 2.59 |
| 47 | 0.45 | 0.78 | 1000 | 165 | 0.78 | 1.00 | 180 | 182 | 2.62 |
| 48 | 0.45 | 0.78 | 1000 | 168 | 0.78 | 1.00 | 180 | 184 | 2.63 |
| 49 | 0.45 | 0.78 | 1000 | 166 | 0.78 | 1.00 | 180 | 181 | 2.72 |
| 50 | 0.45 | 0.78 | 1000 | 167 | 0.78 | 1.00 | 180 | 182 | 2.74 |
| 51 | 0.45 | 0.78 | 1000 | 163 | 0.78 | 1.00 | 180 | 186 | 2.68 |
| 52 | 0.45 | 0.78 | 1000 | 163 | 0.78 | 1.00 | 180 | 186 | 2.68 |
| 53 | 0.45 | 0.78 | 1000 | 165 | 0.78 | 1.00 | 180 | 183 | 2.73 |

| No. | Soft reduction conditions: Reduction rate mm/min | Total bulging amount mm | Evaluation of segregation degree: Number of segregated grains | Evaluation | Evaluation of internal cracking: Internal crack length mm | Evaluation | Determination of cutting | Remarks |
|---|---|---|---|---|---|---|---|---|
| 40 | 0.2 | 12 | 2.73 | ○ | 0 | ◎ | Δ | Invention Example |
| 41 | 0.3 | 12 | 1.25 | ◎ | 0 | ◎ | ○ | Invention Example |
| 42 | 0.9 | 12 | 0.41 | ◎ | 0 | ◎ | ○ | Invention Example |
| 43 | 1.3 | 12 | 0.51 | ◎ | 0 | ◎ | ○ | Invention Example |
| 44 | 1.8 | 12 | 0.55 | ◎ | 0 | ◎ | ○ | Invention Example |
| 45 | 2.0 | 12 | 0.95 | ◎ | 0 | ◎ | ○ | Invention Example |
| 46 | 2.2 | 12 | 2.91 | ○ | 0 | ◎ | ○ | Invention Example |
| 47 | 0.2 | 12 | 3.18 | ○ | 0 | ◎ | Δ | Invention Example |
| 48 | 0.5 | 12 | 0.64 | ◎ | 0 | ◎ | ○ | Invention Example |
| 49 | 0.9 | 12 | 0.45 | ◎ | 0 | ◎ | ○ | Invention Example |
| 50 | 1.3 | 12 | 0.36 | ◎ | 0 | ◎ | ○ | Invention Example |
| 51 | 1.8 | 12 | 0.27 | ◎ | 0 | ◎ | ○ | Invention Example |
| 52 | 2.0 | 12 | 1.01 | ◎ | 0 | ◎ | ○ | Invention Example |
| 53 | 2.2 | 12 | 2.36 | ○ | 0 | ◎ | ○ | Invention Example |

The unit of volume "L" in this Description is $10^{-3}$ m$^3$. An expression of a range of numerical values "x to y" means x or more but y or less, including boundary values.

REFERENCE SIGNS LIST

11 Continuous casting machine
12 Molten steel
13 Casting mold
14 Tundish
15 Immersion nozzle
16 Cast piece support roll
17 Spray nozzle
18 Cast piece
18*a* Unsolidified part inside cast piece
18*b* Solidification completion position
19 Soft reduction zone
20 Segment
20*a* Segment
20*b* Segment
21 Conveyance roll

The invention claimed is:

1. A steel continuous casting method comprising:

cooling of a cast piece is performed at a water volume density per surface area of the cast piece in a first section set within a range of 50 to 2000 L/(m$^2$×min), the first section being a range along a cast piece withdrawing direction in a continuous casting machine, from a start point at which an average value of a solid phase ratio along a thickness direction at a position of a width-direction solidified part at which the solid phase ratio is the lowest in a cast piece width direction is 0.8 or lower to an end point at which the average value of the solid phase ratio along the thickness direction at the position of the width-direction solidified part at which the solid phase ratio is the lowest in the cast piece width direction is higher than the solid phase ratio at the start point but not higher than 1.0.

2. The steel continuous casting method according to claim 1, wherein cooling of the cast piece is performed with the water volume density per surface area of the cast piece in a second section set within a range of 50 to 300 L/(m$^2$×min), the second section being a section which is located downstream of the first section and in which the average value of the solid phase ratio in the width direction at the end point is 1.0 or lower.

3. The steel continuous casting method according to claim 2, wherein at least after the first section ends and while the second section is passed through, casting is performed so as to maintain a nucleate boiling state in which a surface temperature of the cast piece is 200° C. or lower, and a temperature gradient near a center in a thickness of the cast piece at a last solidification stage is set to 1.7 to 3.5 K/mm.

4. The steel continuous casting method according to claim 3, wherein the first section and the second section are each set inside a region restricted to a horizontal segment or a vertical segment in the continuous casting machine.

5. The steel continuous casting method according to claim 4, wherein, in the first section and the second section, soft reduction is applied, and the cast piece is reduced from long-side surfaces at a reduction rate of 0.3 to 2.0 mm/min.

6. The steel continuous casting method according to claim 3, wherein, in the first section and the second section, soft reduction is applied, and the cast piece is reduced from long-side surfaces at a reduction rate of 0.3 to 2.0 mm/min.

7. The steel continuous casting method according to claim 2, wherein the first section and the second section are each set inside a region restricted to a horizontal segment or a vertical segment in the continuous casting machine.

8. The steel continuous casting method according to claim 7, wherein, in the first section and the second section, soft reduction is applied, and the cast piece is reduced from long-side surfaces at a reduction rate of 0.3 to 2.0 mm/min.

9. The steel continuous casting method according to claim 2, wherein, in the first section and the second section, soft reduction is applied, and the cast piece is reduced from long-side surfaces at a reduction rate of 0.3 to 2.0 mm/min.

10. The steel continuous casting method according to claim 1, wherein at least after the first section ends and while the second section is passed through, casting is performed so as to maintain a nucleate boiling state in which a surface temperature of the cast piece is 200° C. or lower, and a temperature gradient near a center in a thickness of the cast piece at a last solidification stage is set to 1.7 to 3.5 K/mm.

11. The steel continuous casting method according to claim 10, wherein the first section and the second section are each set inside a region restricted to a horizontal segment or a vertical segment in the continuous casting machine.

12. The steel continuous casting method according to claim 11, wherein, in the first section and the second section, soft reduction is applied, and the cast piece is reduced from long-side surfaces at a reduction rate of 0.3 to 2.0 mm/min.

13. The steel continuous casting method according to claim 10, wherein, in the first section and the second section, soft reduction is applied, and the cast piece is reduced from long-side surfaces at a reduction rate of 0.3 to 2.0 mm/min.

14. The steel continuous casting method according to claim 1, wherein the first section and the second section are each set inside a region restricted to a horizontal segment or a vertical segment in the continuous casting machine.

15. The steel continuous casting method according to claim 14, wherein, in the first section and the second section, soft reduction is applied, and the cast piece is reduced from long-side surfaces at a reduction rate of 0.3 to 2.0 mm/min.

16. The steel continuous casting method according to claim 1, wherein, in the first section and the second section, soft reduction is applied, and the cast piece is reduced from long-side surfaces at a reduction rate of 0.3 to 2.0 mm/min.

17. The steel continuous casting method according to claim 1, wherein a roll gap of a plurality of pairs of cast piece support rolls is incrementally increased toward a downstream side in a casting direction so as to bulge long-side surfaces of the cast piece by a total bulging amount of 2 to 20 mm, and then the roll gap of the plurality of pairs of cast piece support rolls is incrementally decreased toward the downstream side in the casting direction so as to softly reduce the cast piece.

* * * * *